US005320745A

United States Patent [19]

Cook et al.

[11] Patent Number: 5,320,745

[45] Date of Patent: Jun. 14, 1994

[54] FCC FOR PRODUCING LOW EMISSION FUELS FROM HIGH HYDROGEN AND LOW NITROGEN AND AROMATIC FEEDS WITH CR-CONTAINING CATALYST

[75] Inventors: Bruce R. Cook; William E. Winter; Daniel F. Ryan, all of Baton Rouge, La.

[73] Assignee: Exxon Research and Engineering Company, Florham Park, N.J.

[21] Appl. No.: 982,930

[22] Filed: Nov. 30, 1992

[51] Int. Cl.[5] ..... C10G 11/05; C10G 11/18

[52] U.S. Cl. ..... 208/120; 208/61; 208/89; 208/113; C10G/11/05; C10G/11/18

[58] Field of Search ..... 208/120, 89, 61, 113

[56] References Cited

U.S. PATENT DOCUMENTS 4,153,534 5/1979 Vasalos ..... 208/120

4,260,475 4/1981 Scott ..... 208/113

*Primary Examiner*—R. Bruce Breneman

*Assistant Examiner*—Lorna M. Douyon

*Attorney, Agent, or Firm*—H. E. Naylor

[57] ABSTRACT

A fluid catalytic cracking process for producing relatively low emissions fuels, The feedstock is relatively low in nitrogen and aromatics and high in hydrogen content and the catalyst is an amorphous acidic catalytic material which is promoted with up to about 5000 wppm chromium. The feedstock can be characterized as having less than about 50 wppm nitrogen; greater than about 13 wt. % hydrogen; less than about 7.5 wt. % 2+ ring aromatic cores; and not more than about 15 wt. % aromatic cores overall.

5 Claims, No Drawings

FCC FOR PRODUCING LOW EMISSION FUELS FROM HIGH HYDROGEN AND LOW NITROGEN AND AROMATIC FEEDS WITH CR-CONTAINING CATALYST

FIELD OF THE INVENTION

The present invention relates to a fluid catalytic cracking process for producing low emissions fuels. The feedstock is relatively low in nitrogen and aromatics and high in hydrogen content and the catalyst is an amorphous acidic catalytic material which is promoted with up to about 5000 wppm chromium. The feedstock can be characterized as having less than about 50 wppm nitrogen; greater than about 13 wt. % hydrogen; less than about 7.5 wt. % 2+ ring aromatic cores; and not more than about 15 wt. % aromatic cores overall.

BACKGROUND OF THE INVENTION

Catalytic cracking is an established and widely used process in the petroleum refining industry for converting petroleum oils and residua of relatively high boiling point to more valuable lower boiling products including gasoline and middle distillates such as kerosene, jet fuel and heating oil. The pre-eminent catalytic cracking process now in use is the fluid catalytic process (FCC) in which a pre-heated feed is brought into contact with a hot cracking catalyst, typically a crystalline aluminosilicate material such as a zeolite, which is in the form of a fine powder, typically having a particle size of about 10–300 microns, usually about 100 microns, for the desired cracking reactions to take place. While it would be desirable to have dehydrogenation metals present on the catalyst, they are precluded from modern catalytic cracking because of their adverse effect on the zeolite crystallinity in the hydrothermal environment of the cracking unit. During the cracking, coke and hydrocarbonaceous material are deposited on the catalyst particles. This results in a loss of catalyst activity and selectivity. The coked catalyst particles, and associated hydrocarbon material, are subjected to a stripping process, usually with steam, to remove as much of the hydrocarbon material as technically and economically feasible. The stripped particles, containing non-strippable coke, are removed from the stripper and sent to a regenerator where the coked catalyst particles are regenerated by being contacted with air, or a mixture of air and oxygen, at elevated temperature. This results in the combustion of the coke which is a strongly exothermic reaction which, besides removing the coke, serves to heat the catalyst to the temperatures appropriate for the endothermic cracking reaction. The process is carried out in an integrated unit comprising the cracking reactor, the stripper, the regenerator, and the appropriate ancillary equipment. The catalyst is continuously circulated from the reactor or reaction zone, to the stripper and then to the regenerator and back to the reactor with the circulation rate is typically adjusted relative to the feed rate of the oil to maintain a heat balanced operation in which the heat produced in the regenerator is sufficient for maintaining the cracking reaction with the circulating, regenerated catalyst being used as the heat transfer medium. Typical fluid catalytic cracking processes are described in the monograph Fluid Catalytic Cracking with Zeolite Catalysts, Venuto, P.B. and Habib, E. T., Marcel Dekker Inc. N.Y. 1979, which is incorporated herein by reference. As described in this monograph, catalysts which are conventionally used are based on zeolites, especially the large pore synthetic faujasites, zeolites X and Y.

Typical feeds to a catalytic cracker can generally be characterized as a relatively high boiling oil or residuum, either on its own, or mixed with other fractions, also usually of a relatively high boiling point. The most common feeds are gas oils, that is, high boiling, non-residual oils, with an initial boiling point usually above about 230° C., more commonly above about 345° C., with end points of up to about 620° C. Typical gas oils include straight run (atmospheric) gas oil, vacuum gas oil, and coker gas oil.

While such conventional fluid catalytic cracking processes are suitable for producing conventional transportation fuels, such fuels are generally unable to meet the more demanding requirements of low emission fuels. To meet low emissions standards, the fuel products must be relatively low in sulfur, nitrogen, and aromatics, especially mutiring aromatics. Conventional fluid catalytic cracking is unable to meet such standards. These standards will require either further changes in the FCC process, catalysts, or post-treating of all FCC products. Since post-treating to remove aromatics from gasoline or distillate fuels is particularly expensive, there are large incentives to limit the production of aromatics in the FCC process. Consequently, there exists a need in the art for methods of producing large quantities of low emissions transportation fuels, such as gasoline and distillates.

SUMMARY OF THE INVENTION

In accordance with the present invention, there is provided a fluid catalytic cracking process for producing low emission fuel products, which process comprises the steps of:

(a) introducing a hydrocarbonaceous feedstock into a reaction zone of a catalytic cracking unit comprised of a reaction zone and a regeneration zone, which feedstock is characterized as having: a boiling point from about 230° C. to about 350° C., with end points up to about 620° C.; a nitrogen content less than about 50 wppm; a hydrogen content in excess of about 13 wt. %; a 2+ring aromatic core content of less than about 7.5 wt. %; and an overall aromatic core content of less than about 15 wt. %;

(b) catalytically cracking said feedstock in said reaction zone at a temperature from about 450° C. to about 600° C., by causing the feedstock to be in contact with a cracking catalyst for a contact time of about 0.5 to 5 seconds, which cracking catalyst is an amorphous acidic catalytic material promoted with up to about 5000 wppm chromium; thereby producing lower boiling products and catalyst particles having deposited thereon coke and hydrocarbonaceous material;

(c) stripping said partially coked catalyst particles with a stripping medium in a stripping zone to remove therefrom at least a portion of said hydrocarbonaceous material;

(d) recovering said hydrocarbonaceous material from the stripping zone (e) regenerating said coked catalyst in a regeneration zone by burning-off a substantial amount of the coke on said catalyst, optionally with an added fuel component to maintain the regenerated catalyst at a temperature which will maintain the catalytic cracking reactor at a temperature from about 450° C. to about 600° C.; and (f) recycling said regenerated hot catalyst to the reaction zone.

In preferred embodiments of the present invention, an added fuel component is used in the regeneration zone and is selected from: $C_2$ light gases from the catalytic cracking unit, and natural gas.

In preferred embodiments of the present invention the amorphous acidic material is a silica-alumina material containing about 10 to 40 wt. % alumina.

In other preferred embodiments of the present invention the contact time in the cracking unit is about 0.5 to 3 seconds.

DETAILED DESCRIPTION OF THE INVENTION

The practice of the present invention results in the production of less aromatic naphtha products as well as the production of more $C_3$ and $C_4$ olefins which can be converted to high octane, non-aromatic alkylates, such as methyl tertiary butyl ether.

Feedstocks which are suitable for being converted in accordance with the present invention are any of those hydrocarbonaceous feedstocks which are conventional feedstocks for fluid catalytic cracking and which have an initial boiling point of about 230° C. to about 350° C., with an end point up to about 620° C. The feedstocks of the present invention must also contain no more than about 50 wppm nitrogen, no more than about 7.5 wt. % 2+ring aromatic cores, no more than about 15 wt. % aromatic cores overall, and at least about 13 wt. % hydrogen. Non-limiting examples of such feeds include the non-residual petroleum based oils such as straight run (atmospheric) gas oil, vacuum gas oil and coker gas oil. Oils from synthetic sources such as coal liquefaction, shale oil, or other synthetic processes may also yield high boiling fractions which may be catalytically cracked either on their own or in admixture with oils of petroleum origin. Feedstocks which are suitable for use in the practice of the present invention may not be readily available in a refinery. This is because typical refinery streams in the boiling point range of interest which are conventionally used for fluid catalytic cracking, generally contain too high a content of undesirable components such as nitrogen, sulfur, and aromatics. Consequently, such streams will need to be upgraded, or treated to lower the level of such undesirable components. Non-limiting methods for upgrading such streams include hydrotreating in the presence of hydrogen and a supported Mo containing catalyst with Ni and or Co; extraction methods, including solvent extraction as well as the use of solid absorbents, such as various molecular sieves. It is preferred to hydrotreat the streams.

Any suitable conventional hydrotreating process can be used as long as it results in a stream having the characteristics of nitrogen, sulfur, and aromatics level previously mentioned. That is nitrogen levels of less than about 50 wppm, preferably less than about 5 wppm; a hydrogen content of greater than about 13 wt. %, preferably greater than about 13.5 wt. %; a 2+ring aromatic core content of less than about 7.5 wt. %, preferably less than about 4 wt. %; and an overall aromatic core content of less than about 15 wt. %, preferably less than about 8 wt. %.

Suitable hydrotreating catalysts are those which are typically comprised of a Group VIB (according to the Sargeant-Welch Scientific Company Periodic Table) metal with one or more Group VIII metals as promoters, on a refractory support. It is preferred that the Group VI metal be molybdenum or tungsten, more preferably molybdenum. Nickel and cobalt are the preferred Group VIII metals with alumina being the preferred support. The Group VIII metal is present in an amount ranging from about 2 to 20 wt. %, expressed as the metal oxides, preferably from about 4 to 12 wt. %. The Group VI metal is present in an amount ranging from about 5 to 50 wt. %, preferably from about 10 to 40 wt. %, and more preferably from about 20 to 30 wt. %. All metals weight percents are based on the total weight of the catalyst. Any suitable refractory support can be used. Such supports are typically inorganic oxides, such as alumina, silica, silica-alumina, titania, and the like.

Suitable hydrotreating conditions include temperatures from about 250° to 450° C., preferably from about 350° C. to 400° C.; pressures from about 250 to 3000 psig; preferably from about 1500 to 2500 psig; hourly space velocities from about 0.05 to 6 V/V/Hr; and a hydrogen gas rate of about 500 to 10000 SCF/B; where SCF/B means standard cubic feet per barrel, and V/V/Hr means volume of fuel per volume of the catalyst per hour.

A hydrocarbonaceous feedstock which meets the aforementioned requirements for producing a low emissions fuel is fed to a conventional fluid catalytic cracking unit. The catalytic cracking process may be carried out in a fixed bed, moving bed, ebullated bed, slurry, transfer line (dispersed phase) riser, or dense bed fluidized bed operation. It is preferred that the catalytic cracking unit be a fluid catalytic cracking (FCC) unit. Such a unit will typically contain a reactor where the hydrocarbonaceous feedstock is brought into contact with hot powdered catalyst particles which were heated in a regenerator. Transfer lines connect the two vessels for moving catalyst particles back and forth. The cracking reaction will preferably be carried out at a temperature from about 450° to about 680° C., more preferably from about 480° to about 560° C.; pressures from about 5 to 60 psig, more preferably from about 5 to 40 psig; contact times (catalyst in contact with feed) of about 0.5 to 10 seconds, more preferably about I to 6 seconds; and a catalyst to oil ratio of about 0.5 to 15, more preferably from about 2 to 8. During the cracking reaction, lower boiling products are formed and some hydrocarbonaceous material, and non-volatile coke are deposited on the catalyst particles. The hydrocarbonaceous material is removed by stripping, preferably with steam. The non-volatile coke is typically comprised of highly condensed aromatic hydrocarbons which generally contain about 4 to 10 wt. % hydrogen. As hydrocarbonaceous material and coke build up on the catalyst, the activity of the catalyst for cracking, and the selectivity of the catalyst for producing gasoline blending stock are diminished. The catalyst particles can recover a major proportion of their original capabilities by removal of most of the hydrocarbonaceous material by stripping and the coke by a suitable oxidative regeneration process. Consequently, the catalyst particles are sent to a stripper and then to a regenerator.

Catalyst regeneration is accomplished by burning the coke deposits from the catalyst surface with an oxygen-containing gas such as air. Catalyst temperatures during regeneration may range from about 560° C. to about 760° C. The regenerated, hot catalyst particles are then transferred back to the reactor via a transfer line and, because of their heat, are able to maintain the reactor at the temperature necessary for the cracking reaction. Coke burn-off is an exothermic reaction, therefore in a conventional fluid catalytic cracking unit with conventional feeds, no additional fuel needs to be added. The feedstocks used in the practice of the present invention, primarily because of their low levels of aromatics, and also due to the relatively short contact times in the reactor or transfer line, do not deposit enough coke on the catalyst particles to achieve the necessary temperatures in the regenerator. Therefore, it will be necessary to use an additional fuel to provide increased temperatures in the regenerator so the catalyst particles returning to the reactor are hot enough to maintain the cracking reaction. Non-limiting examples of suitable additional fuel include $C_2^-$ gases from the catalytic cracking process itself; natural gas; and any other non-residual petroleum refinery stream in the appropriate boiling range. Such additional fuels are sometimes referred to as torch oils. Preferred are the $C_2^-$ gases.

Catalysts suitable for use in the present invention are chromium promoted amorphous acidic catalytic materials. It is preferred that the amorphous acidic material have a surface area after commercial deactivation, or after steaming at 760° C. for 16 hrs, from about 75 to 200 $m^2/g$, more preferably from about 100 to 150 $m^2/g$. Amorphous acidic catalytic materials suitable for use herein include: alumina, silica-alumina, silica-magnesia, silica-zirconia, silica-thoria, silica-beryllia, silica-titania, and the like. Preferred is a silica-alumina material having from about 10 to 40 wt. % alumina. Such materials will typically have a pore volume of at least about 0.3cc per gram. In general, higher pore volumes are preferred as long as they are not so high as to adversely affect the attrition resistance of the catalyst. Thus, the pore volume of the amorphous catalytic material will be at least about 0.3cc per gram, preferably from about 0.4 to 1.5cc per gram, and more preferably from about 0.8 to 1.3cc per gram, and most preferably from about 1 to 1.2cc per gram.

The amorphous acidic material is promoted with up to about 5000 wppm chromium. Preferred is from about 100 wppm to 3000 wppm chromium, and more preferred is from about 500 wppm to 1500 wppm. The chromium may be incorporated into the amorphous material by any suitable technique. Two preferred techniques are ion-exchange and incipient wetness techniques. A typical ion-exchange technique would involve treating the amorphous material with a fluid medium, preferably a liquid medium, containing chromium cations. Chromium salts represent the source of the chromium cations. The product resulting from treating the amorphous material with a chromium-containing fluid medium is an activated amorphous catalytic material which has been modified primarily to the extent of having the chromium cations chemisorbed or ionically bonded thereto.

The incorporation of the chromium cations is preferably carried out to insure essentially complete dispersion of the chromium metal. Water is the preferred solvent for the chromium salt for reasons of economy and ease of preparation in large scale operations involving continuous or batchwise treatment. Similarly, for this reason, organic solvents are less preferred but can be employed providing the solvent permits ionization of the cationic salt. Typical solvents include cyclic and acyclic ethers such as dioxane, tetrahydrofuran, ethyl ether, diethyl ether, diisopropyl ether, and the like; ketones, such as acetone and methyl ethyl ketone; esters such as ethyl acetate; alcohols such as ethanol, propanol, butanol, etc; and miscellaneous solvents such as dimethyl formamide, and the like.

Generally, the particle size of the catalyst will be in the range typically used for fluid bed catalysts. Generally this size will range from about 10 to 300 microns in diameter, with an average particle diameter of about 60 microns.

The following examples are presented for illustrative purposes and should not be taken as limiting the invention in any way.

EXAMPLE 1 (Comparative)

Cracking tests were conducted in a microactivity test (MAT) unit. Such a test unit is described in the Oil and Gas Journal, 1966 Vol.64, pages 7, 84, 85 and Nov. 22, 1971, pages 60–68, which is incorporated herein by reference. Run conditions in the MAT unit were as follows:

Temperature, ° C. 525
Run Time, Sec. 30
Catalyst Charge, gr. 4.1
Amount Feed, cc. 1.1
Cat/Oil ratio 4.2 to 4.5

Tests were made with two fresh, steamed, catalysts. The catalysts were steamed for 16 hours at 760° C. to simulate commercially deactivated catalysts. The first catalyst (ZA) is commercially available from Davison under the tradename Octacat. Catalyst ZA contains a USY zeolite (LZY-82 from Union Carbide) but no rare earths. It is formulated in a silica-sol matrix and after steaming, or commercial deactivation, it is a relatively low unit cell size catalyst. The second catalyst was an amorphous silica/alumina gel catalyst, 3A, commercially available from Davison. The composition and properties of catlyst ZA and 3A are as shown below.

| CATALYST | ZA | 3A |
|---|---|---|
| $Al_2O_3$ | 26.0 wt.% | 25 wt.% |
| $SiO_2$ | 73.0 | 75 |
| $Re_2O_3$ | 0.02 | 0 |
| $Na_2O$ | 0.25 | — |
| After calcination for 4 hrs at 538° C. | | |
| Surface Area, $M^2/g$ | 297.5 | — |
| Pore Volume, cc,/g | 0.24 | — |
| Unit Cell Size, A | 24.44 | — |
| After steaming for 16 hrs at 405° C. | | |
| Surface Area, $M^2/g$ | 199.5 | 128 |
| Pore Volume, cc/g | 0.20 | 0.49 |
| Unit Cell Size, A | 24.25 | — |

A raw and two hydrotreated Arab Light VGO (virgin gas oil) streams, were used as feeds for catalytic cracking experiments. A commercially available NiMo on alumina catalyst, available from ketjen as catalyst KF-843, was used to hydrotreat the feeds. The hydrotreated feeds were designated as HA2+ and HA1+. HA1+ was more severely hydrotreated than HA2+. The raw Arab light vacuum gas oil (VGO) is designated as RA+. Arab Light VGO is a typical, conventional feedstock for fluid catalytic cracking. The properties of the raw and hydrotreated feeds are set forth below.

Properties of Raw and Hydrotreated Arab Light VGO

| | HA2+ | HA1+ | RA+ |
|---|---|---|---|
| Wppm N | 0.7 | <.5 | 596 |
| Wt. % S | <0.01 | <0.01 | 1.99 |
| Wt. % C | 86.11 | 85.70 | 85.86 |

-continued

| Properties of Raw and Hydrotreated Arab Light VGO | HA2+ | HA1+ | RA+ |
|---|---|---|---|
| Wt. % H | 13.89 | 14.30 | 12.09 |
| Wt. % Saturates | 93.7 | 95.7 | 47.8 |
| Wt. % 1 Ring Aromatics | 4.2 | 2.3 | 17.1 |
| Wt. % Total Arom. Cores | 2.0 | 1.3 | 21.5 |
| Wt. % 2+ Ring Cores | 1.4 | 1.0 | 16.8 |

The total liquid product from the MAT tests amounted to about 0.3 to 0.7 grams and was analyzed using two different gas chromatography instruments. A standard analysis was the boiling point distribution determined by gas chromatographic distillation (GCD) to evaluate: (1) the amount of material boiling less than 15° C.; (2) naphtha boiling between 15° C. and 220° C.; (3) light cat cycle oil (LCCO) boiling between 220° C. and 345° C.; and (4) bottoms boiling above 345° C. For selected tests, another portion of the sample was analyzed on a PIONA instrument which is a multidimensional gas chromatography (using several columns) to determine the molecular types according to carbon number from $C_3$ to $C_{11}$. The types include normal paraffins, isoparaffins, naphthenes, normal olefins, iso-olefins, cyclo-olefins, and aromatics.

Detailed cracking data are given in Table I below for the raw and hydrotreated Arab Light VGO feeds.

TABLE I

| Cracking of Raw Arab Light VGO with Catalyst ZA vs Clean Feed with 3A @ 525° C. and 4.5 Cat/Oil | | | |
|---|---|---|---|
| Feed | RA+ | HA1+ | HA2+ |
| Catalyst | ZA | 3A | 3A |
| Conversion (220° C.) | 67.1 | 69.1 | 65.0 |
| Yields, Wt % | | | |
| Coke | 2.35 | 0.37 | 0.69 |
| $C_2^-$ dry gases | 2.17 | 1.05 | 1.55 |
| $C_3H_6$ | 4.7 | 8.5 | 6.4 |
| $C_3H_8$ | 0.95 | 0.71 | 0.43 |
| $C_4H_8$ | 5.9 | 13.7 | 10.5 |
| Iso-$C_4H_{10}$ | 4.2 | 3.5 | 2.5 |
| N—$C_4H_{10}$ | 0.88 | 0.49 | 0.29 |
| 15°-220° C. Naphtha | 45.9 | 41.1 | 42.5 |
| LCCO | 15.6 | 2.9 | 6.3 |
| Bottoms | 17.2 | 27.9 | 28.7 |
| 15°-220° C. Naphtha | | | |
| Aromatics | 32.4 | 7.5 | 13.3 |
| Olefins | 27.6 | 65.6 | 62.7 |

The above table shows that conversion obtained with the conventional fluid catalytic cracking feed RA+and zeolitic catalyst ZA is bracketed by the conversions obtained with the two clean feeds of this invention and the amorphous silica-alumina catalyst 3A. Furthermore, the naphtha produced from the clean feed with a low hydrogen transfer catalyst (3A) is substantially less aromatic than naphtha produced by conventional fluid catalytic cracking. Also, propylene and butylene yields are higher.

EXAMPLE 2

Further cracking tests were conducted in a MAT test unit. Run conditions in the MAT unit were as follows:

Temperature, ° C. 482
Run Time, Sec. 30
Catalyst Charge, gr. 4.1
Amount Feed, cc. 1.1
Cat/Oil ratio 1.5

Several catalysts were used for those experiments. The first was an unmodified amorphous silica-alumina catalyst material to simulate commercial deactivation calcined at 1000° C. and steamed for 10 hours at 760° C. After steaming, the 3A catalyst had a surface area of about 125 $m^2/g$.

Four chromium-containing catalysts were prepared from this amorphous silica-alumina. They were prepared by ion-exchanging the silica-alumina material with various amounts of chromium(III) by contacting the silica-alumina material with a dilute aqueous solution of chromic nitrate containing the desired amount of chromium. The resulting chromium exchanged silica-aluminas were then isolated by filtration and subsequently calcined at 1000° C. and steamed. The four chromium promoted silica-alumina catalyst materials which were prepared contained 1050 wppm Cr (Catalyst B), 1410 wppm Cr (Catalyst C), 2610 wppm Cr (Catalyst D), and 3130 wppm Cr (Catalyst E). These four catalysts are catalysts of this invention.

Finally, a zeolite cracking catalyst (Catalyst F) was prepared using techniques well known in the art and containing 20% ultra-stable Y (USY) zeolite as the active component in an inactive matrix comprised of silica sol and clay. This catalyst was calcined and steamed for 16 hours at 760° C. to simulate commercial deactivation. The zeolite had a unit cell size of 24.24A after steaming.

The feed used for these experiments was prepared by extracting aromatic compounds from a petroleum VGO in a commercial lubes process. The raffinate from this extraction was processed further to prepare a highly naphthenic, dewaxed oil. The dewaxed oil contained 53 wppm nitrogen, 0.20 wt. % sulfur, and 13.55 wt. % hydrogen. This is a feed of our invention.

TABLE II

| Catalyst | 3A | | B | C | D | E | F |
|---|---|---|---|---|---|---|---|
| Catalyst/Oil | 3.0 | 1.5 | 1.5 | 1.5 | 1.5 | 1.5 | 1.5 |
| Conversion (220° C.) | 77.9 | 66.8 | 70.5 | 73.5 | 70.5 | 68.2 | 71.4 |
| Yields Wt % | | | | | | | |
| Coke | 1.80 | 0.36 | 1.01 | 1.04 | .90 | 1.04 | 0.50 |
| Hydrogen | 0.052 | 0.020 | 0.048 | 0.063 | 0.068 | 0.074 | 0.021 |
| $C_3 + C_4$ Olefins | 7.5 | 4.9 | 5.5 | 6.2 | 6.2 | 5.1 | 4.6 |
| $C_3 + C_4$ Paraffins | 2.3 | 1.1 | 2.45 | 2.4 | 2.3 | 2.1 | 2.6 |
| 15°-220° C. Naphtha | 5.38 | 50.2 | 51.0 | 53.1 | 52.3 | 49.1 | 56.0 |
| $C_3 + C_4$ Olefins/Sats | 3.3 | 4.4 | 2.3 | 2.6 | 2.7 | 2.4 | 1.8 |

Results are shown in this table from cracking this clean, almost entirely naphthenic feed over Catalyst 3A at catalyst/oil ratios 1.5 and 3.0, and Catalysts B-F at a catalyst to oil ratio of 1.5. Chromium promotion of silica-alumina's, as low as 1000 ppm (Catalyst B) clearly results in a significant increase in both conversion to <220° C. boiling material, and propene and butenes yields over conventional silica-alumina (Catalyst 3A). Some additional benefit is observed if the chromium content of the catalyst is increased much above 1500 ppm (Catalyst C) with light debits in conversion and olefin yield observed above this amount (Catalysts D and E). The conversion enhancements observed for this naphthenic feed are significantly lower than both the Fischer-Tropsch wax of Example 4 to follow, and the hydrotreated light Arab VGO (Example 3), consistent with its very low paraffin composition, and its higher nitrogen content. Catalysts B and C show comparable conversions to the zeolitic Catalyst F, but still show significant credits in $C_3$ and $C_4$ olefin production.

EXAMPLE 3

Further cracking tests were conducted in the same MAT unit, with the same catalysts, and at the same conditions described in Example 2. The feed used for these tests was a hydrotreated Arab Light VGO containing only 3 wppm nitrogen, 0.02 wt. % sulfur, and 13.27 wt. % hydrogen. This is a preferred clean feed of this invention

TABLE III

| Catalyst | 3A | | B | C | D | E | F |
|---|---|---|---|---|---|---|---|
| Catalyst/Oil | 3.0 | 1.5 | 1.5 | 1.5 | 1.5 | 1.5 | 1.5 |
| Conversion (220° C.) | 61.1 | 46.2 | 60.8 | 56.7 | 56.7 | 57.5 | 65.2 |
| Yields Wt % | | | | | | | |
| Coke | 0.70 | 0.19 | 0.64 | 0.62 | 0.61 | 0.62 | 0.32 |
| Hydrogen | 0.050 | 0.012 | 0.047 | 0.037 | 0.041 | 0.053 | 0.017 |
| $C_3 + C_4$ Olefins | 5.4 | 2.6 | 5.1 | 4.1 | 4.1 | 4.4 | 4.2 |
| $C_3 + C_4$ Paraffins | 3.8 | 0.8 | 2.05 | 1.7 | 1.8 | 1.7 | 2.5 |
| 15°-220° C. Naphtha | 44.2 | 38.4 | 45.9 | 44.2 | 44.5 | 44.5 | 51.9 |
| $C_3 + C_4$ Olefins/Sats | 1.4 | 3.2 | 2.5 | 2.4 | 2.3 | 2.6 | 1.7 |

Results are shown in Table III above from cracking this clean feed composed of mostly paraffins and naphthenes over Catalyst 3A at cat/oil ratios 1.5 and 3.0, and Catalysts B–F at a catalyst to oil ratio of 1.5. Chromium promotion of silica-alumina's, as low as 1000 ppm (Catalyst B) clearly results in large increases in both conversion to <220° C. boiling material, and propene and butenes yields over conventional silica-alumina (Catalyst 3A). No additional benefit is observed if chromium content of the catalyst is increased above 1000 ppm and debits in conversion and olefin yield observed above this amount (Catalysts C–E). Coke production and increased hydrogen yields were also observed from the chromium promoted silica-aluminas, but these appear to be the simple consequence of increased conversion, which is supported by the comparable numbers found for 3A at the more severe 3.0 cat/oil. The conversion enhancements observed for this hydrotreated Arab Light VGO are about half of that observed for the hydroisomerized Fischer-Tropsch feed in Example 4 to follow, which is consistent with the feeds higher nitrogen content and lower paraffins content. Catalyst B still shows an advantage over zeolitic Catalyst F for producing $C_3$ and $C_4$ olefins and shows a slightly lower activity for <220° C. conversion.

EXAMPLE 4

Further cracking tests were performed in the same MAT unit, with the same catalysts, and at the same conditions described in Example 2. The feed used for these tests was a hydroisomerized Fischer-Tropsch wax. This synthetic fuel is substantially 100% paraffinic and is substantially free of nitrogen, sulfur, and aromatic cores.

TABLE IV

| Catalyst | 3A | B | C | D | E | F |
|---|---|---|---|---|---|---|
| Conversion (220° C.) | 70.4 | 88.0 | 88.9 | 87.6 | 87.2 | 86.4 |
| Yields Wt % | | | | | | |
| Coke | 0.18 | 0.39 | 0.43 | 0.46 | 0.27 | 0.37 |
| Hydrogen | 0.008 | 0.017 | 0.015 | 0.018 | 0.021 | 0.010 |
| $C_3 + C_4$ Olefins | 7.8 | 15.7 | 15.7 | 15.5 | 15.2 | 10.4 |
| $C_3 + C_4$ Paraffins | 1.4 | 4.3 | 4.4 | 4.4 | 3.9 | 3.5 |
| 15°-220° C. Naphtha | 45.1 | 57.2 | 56.3 | 54.9 | 55.9 | 60.5 |
| $C_3 + C_4$ Olefins/Sats | 5.6 | 3.4 | 3.6 | 3.5 | 3.9 | 3.0 |

Results are shown i n Table I I from cracking this 100% paraffin feed over Catalysts 3A, B, C, D, E, and F at a catalyst to oil ratio of 1.5. Chromium promotion of silica-alumina's, as low as 1000 ppm (Catalyst B) clearly results in large increases in both conversion to <220° C. boiling material, and propene and butenes yields over conventional silica-alumina (Catalyst 3A). Little additional benefit is observed if chromium content of the catalyst is increased much above 1500 ppm (Catalyst C) with slight debits in conversion and olefin yield observed above this amount (Catalysts D and E). Increased production of undesirable coke, hydrogen, and light saturated gases ($C_3$ and $C_4$paraffins) are observed over Catalysts B–E, but these increases are consistent with the higher conversions obtained with chromium promoted silica-alumina catalysts. This conclusion is supported by the fact that the coke make found for the conventional zeolitic Catalyst F is comparable to all the chromium promoted catalysts.

Chromium promoted silica-aluminas (Catalysts B–E) are also superior in many ways to the zeolitic catalyst. Catalyst F, which contains 20% USY, shows comparable conversion to Catalysts B–E, but high value $C_3$ and $C_4$ olefin yields are seriously diminished relative to the chromium containing silica-aluminas. This example shows that the high propylene and butylene yields obtained with low hydrogen transfer silica-alumina catalysts can be further improved by chromium promotion.

EXAMPLE 5 (Comparative)

Further cracking tests were performed in the same MAT unit, with the same catalysts,. and at the same conditions described in Example 2 except that a cat/oil of 3.0 was used instead of 1.5. This cat/oil was used because the feed used for this experiment is a conventional petroleum VGO containing 570 ppm nitrogen, 24.2 wt. % aromatic cores. This waxy VGO also contains about 15 wt. % of paraffin components. However, this is not a feed of this invention.

TABLE V

| Catalyst | 3A | B | C | D | E | F |
|---|---|---|---|---|---|---|
| Conversion (220° C.) | 37.1 | 50.6 | 49.7 | 48.5 | 48.7 | 55.0 |
| Yields Wt % | | | | | | |
| Coke | 1.12 | 2.39 | 2.40 | 2.35 | 2.32 | 1.07 |
| Hydrogen | .024 | .090 | .103 | .110 | .111 | .036 |
| $C_3 + C_4$ Olefins | 2.5 | 4.3 | — | 3.9 | 4.1 | 3.8 |
| $C_3 + C_4$ Paraffins | .8 | 2.45 | — | 2.0 | 2.0 | 2.3 |
| 15°-220° C. Naphtha | 25.8 | 32.9 | 32.2 | 32.9 | 32.2 | 38.6 |
| $C_3 + C_4$ Olefins/Sats | 3.1 | 1.8 | — | 2.0 | 2.0 | 1.6 |

Results are shown in Table V above from cracking this feed composed of mostly paraffins and naphthenes over Catalysts 3A, B, C, D, E, and F. Chromium promotion of silica-aluminas, as low as 1000 ppm (Catalyst B) results in large increases in both conversion to <220° C. boiling material, and propene and butenes yields over conventional silica-alumina (Catalyst 3A). No additional benefit is observed if chromium content of the catalyst is increased above 1000 ppm and debits in conversion and olefin yield observed above this amount (Catalysts C–E). The conversion enhancements observed for the chromium promoted catalyst is consistent with the paraffin component of this feed.

However, coke and hydrogen yields with the chromium promoted catalysts are relatively high. Zeolite catalyst F produces less coke and hydrogen at a higher conversion. These relatively high coke yields would limit conversion of conventional feeds by chromium promoted catalysts in a commercial heat balanced fluid catalytic cracking operation. Finally, chromium promotion of silica-alumina catalysts provides little or no improvement in light olefins selectivity from conventional FCC feeds relative to zeolite catalyst F. The small differences between $C_3$ and $C_4$ olefins to saturates shown in this example are due to lower conversion relative to catalyst F.

What is claimed is:

1. A fluid catalytic cracking process for producing low emission fuel products, which process comprises the steps of:

(a) introducing a hydrocarbonaceous feedstock into a reaction zone of a catalytic cracking unit comprised of a reaction zone and a regeneration zone, which feedstock is characterized as having: an initial boiling point from about 230° C. to about 350° C., with end points up to about 620° C.; a nitrogen content less than about 50 wppm; a hydrogen content is in excess of about 13 wt. %; a 2+ ring aromatic core content of less than about 7.5 wt. %; and an overall aromatic core content of less than about 15 wt. %;

(b) catalytically cracking said feedstock in the catalytic cracking unit operated at a temperature for about 450° C. to about 600° C., by causing the feedstock to be in content with a cracking catalyst for a content time of about 1 to 5 seconds, which cracking catalyst is comprised of a chromium-containing amorphous acidic catalytic material having a surface area, after steaming at 760° C. for 16 hours, from about 75 to 20 $m^2/g$, and promoted with up to about 5000 wppm chromium, thereby producing lower boiling hydro carbonaceous products and a partially coked catalyst;

(c) regenerating said partially coked catalyst in a regeneration zone by burning-off a substantial amount of the coke on said catalyst, and with any added fuel component to maintain the regenerated catalyst at a temperature which will maintain the catalytic cracking reactor at a temperature from bout 450° C. to about 600° C.; and (d) recycling said regenerated catalyst to the reaction zone.

2. The process of claim 1 wherein the amorphous acidic material is a silica-alumina material containing from about 15 to 25 wt. % alumina.

3. The process of claim 2 wherein the amount of chromium is from about 100 to 3000 wppm.

4. The process of claim 3 wherein the hydrocarbonaceous feedstock contains: less than about 20 wppm nitrogen, greater than about 13.5 wt. % hydrogen, less than about 4 wt. % of 2+ring aromatic cores, and an overall aromatic core content of less than about 8 wt. %.

5. The process of claim 4 wherein the amorphous silica-alumina material contains from about 15 to 25 wt. % alumina and from about 100 to 3000 wppm chromium.

* * * * *